US009074327B2

(12) United States Patent
Reichle et al.

(10) Patent No.: US 9,074,327 B2
(45) Date of Patent: Jul. 7, 2015

(54) RAILROAD ATTACHMENT CLAMP

(71) Applicants: David Lee Reichle, Bradenton, FL (US); Brenda Reichle, Bradenton, FL (US)

(72) Inventors: David Lee Reichle, Bradenton, FL (US); Steven Adam Saplin, Denver, CO (US)

(73) Assignees: David L. Reichle, Bradenton, FL (US); Brenda Reichle, Bradenton, FL (US)

( * ) Notice: Subject to any disclaimer, the term of this patent is extended or adjusted under 35 U.S.C. 154(b) by 147 days.

(21) Appl. No.: 13/973,222

(22) Filed: Aug. 22, 2013

(65) Prior Publication Data

US 2014/0054389 A1 Feb. 27, 2014

Related U.S. Application Data

(60) Provisional application No. 61/692,780, filed on Aug. 24, 2012.

(51) Int. Cl.
*E01B 26/00* (2006.01)

(52) U.S. Cl.
CPC ..... *E01B 26/00* (2013.01)

(58) Field of Classification Search
CPC ..... E01B 7/00; E01B 7/24; E01B 26/00; E01B 26/005; E01B 19/00; H05B 3/00; H02G 3/32
See application file for complete search history.

(56) References Cited

U.S. PATENT DOCUMENTS

| | | | | |
|---|---|---|---|---|
| 2,529,153 | A | 11/1950 | Hain | |
| 2,875,969 | A * | 3/1959 | Thompson | 248/72 |
| 2,886,088 | A | 5/1959 | Brancato | |
| 2,910,567 | A | 10/1959 | Holstein | |
| 3,233,097 | A | 2/1966 | Watkins | |
| 3,243,573 | A | 3/1966 | Weisse et al. | |
| 3,264,472 | A | 8/1966 | Simmons | |
| 3,349,722 | A | 10/1967 | Davis | |
| 3,394,251 | A | 7/1968 | King et al. | |
| 3,439,161 | A | 4/1969 | McElwee et al. | |
| 3,697,746 | A | 10/1972 | Patterson et al. | |
| 3,830,427 | A | 8/1974 | Polidori | |
| 4,195,805 | A | 4/1980 | Keep, Jr. | |
| RE31,081 | E | 11/1982 | Keep, Jr. | |
| 4,391,425 | A | 7/1983 | Keep, Jr. | |
| 4,429,845 | A * | 2/1984 | Stover et al. | 246/428 |
| 4,671,475 | A | 6/1987 | Widmer | |
| 5,004,190 | A * | 4/1991 | Montierth et al. | 246/428 |
| 5,288,016 | A | 2/1994 | Owen | |
| 5,824,997 | A * | 10/1998 | Reichle et al. | 219/537 |
| 6,104,010 | A | 8/2000 | Reichle et al. | |
| 6,213,407 | B1 * | 4/2001 | Ellis et al. | 238/310 |
| 7,693,623 | B2 * | 4/2010 | Fox et al. | 701/19 |
| 7,992,797 | B2 | 8/2011 | Reichle | |
| 8,157,186 | B2 * | 4/2012 | Reichle et al. | 238/14.2 |
| 2006/0032934 | A1 * | 2/2006 | Reichle | 238/14.05 |
| 2006/0150563 | A1 * | 7/2006 | Naheem | 52/698 |
| 2012/0261386 | A1 * | 10/2012 | Reichle | 219/50 |
| 2014/0054389 | A1 * | 2/2014 | Reichle et al. | 238/310 |

* cited by examiner

*Primary Examiner* — Jason C Smith
(74) *Attorney, Agent, or Firm* — Marsh Fischmann & Breyfogle LLP

(57) ABSTRACT

A clamp for non-invasively attaching components to railroad track rails. The clamp provides a receiving slot for receiving a first flange of a track rail between upper and lower legs. Disposed within the slot is a resilient member or spring that is compressed when engaged by the first flange of the track rail. Compression of the resilient member allows for positioning a tab attached to a free end of the lower leg over an outside edge of a second flange of the track rail.

18 Claims, 6 Drawing Sheets

RAILROAD ATTACHMENT CLAMP

CROSS REFERENCE

This application claims the benefit of the filing date of U.S. Provisional Application No. 61/692,780 entitled: "Railroad Attachment Clamp" and having a filing date of Aug. 24, 2012, the entire contents of which is incorporated herein by reference.

FIELD

The present disclosure relates to a friction clamp system that allows for holding objects relative to a railroad track rail such as, for example a heater element signal line, wire or cable.

BACKGROUND

Railroad track switches typically involve a pair of stationary rails and a pair of switching rails that move between engaged and disengaged positions. In the engaged position, commonly referred to as the "reverse position," a switching rail abuts the gauge side of a stationary rail, i.e., the side which engages the flange of a train wheel, so as to divert the train wheel from the stationary rail and the corresponding track to another track. In the disengaged position, commonly known as the "normal position," the switching rail is separated from the gauge side of the stationary rail so that a passing wheel is unaffected by the switching rail.

In order to ensure proper functioning of a railroad switch, it is important that the switching rail and stationary rail make good contact in the engaged position. Accordingly, in cold climates, it is common to heat the tracks forming the rail switch to guard against build up of ice or snow at the switch.

A number of different types of track switch heaters have been devised including heaters that operate on radiant (e.g., infrared element), convective (e.g., forced air); and/or conductive (e.g., electrical heater element) principles. Among these, certain heaters have relative advantages for particular applications based on efficiency, availability of an appropriate power source at a remote location or other considerations.

Components such as heaters are often anchored directly to the track rail utilizing bolts and/or welds. In this regard, a hole may be drilled into the track rail for mounting purposes, or, a portion of the component may be welded directly to the track rail. Such interconnection techniques are generally labor intensive and require careful positioning to prevent structurally weakening the track rail. Such connection techniques can result in a stress concentration within the track rail. Further, the heat of exothermic connectors (welding) can result in a brittleness in the track rail. As will be appreciated, track rails are subjected to repeated heavy loading (e.g., railroad traffic) and areas including such stress concentrations and/or brittleness may be subject to failure.

SUMMARY

One objective of the present disclosure is to provide an improved system and method for attaching a component to a track rail. Another objective of the present disclosure is to provide a clamp/connector for quickly and securely coupling a component to a track rail These and/or other objectives may be accomplished by various systems and methods (i.e., utilities) that utilize a biasing clamp that securely attaches to a track rail. In one arrangement, the biasing clamp may be attached to a track rail without the use of tools or other implements (e.g., by hand). In one specific arrangement, the biasing clamp is configured to support a heater element relative to a track rail.

According to a first aspect, an anchor or clamp is provided for securing a component relative to the surface of a track rail. The clamp includes a U-shaped body having a first or upper leg adapted for disposition above a first flange of a foot of the track rail. The U-shaped body further includes a second or lower leg that is adapted for positioning the beneath and across at least a portion of the bottom surface of the foot of the track rail. The upper and lower legs are attached at a first end defining a closed end of the U-shaped body. The first and second legs are disposed in a spaced opposing relationship defining a receiving slot, which is sized to receive the first flange of the track rail therein. Disposed within the slot defined between the upper and lower leg is at least a first resilient member having at least a first portion that is oriented for compression between an interior of the slot of the U-shaped body and a surface of the track rail when the first flange of the track rail is disposed within the slot.

In one arrangement, the lower leg extends across the entirety of the bottom surface of the foot of the track rail and further includes a tab attached to its free end. This tab extends above the surface of the bottom leg and is adapted to engage in outside edge of the second flange of the foot of the track rail when the resilient member is compressed by the first flange of the track rail. In one specific arrangement, the length of the tab is less than the thickness of the outside edge of the second flange of the track rail.

In a further arrangement, the first portion of the resilient member is oriented such that it is compressed between the upper leg and a top surface of the first flange. In a further arrangement, the resilient member includes a second portion that is compressed between the closed and the U-shaped body and the outside edge of the first flange when the first flange disposed within the slot between the upper and lower legs. The first and second portions of the resilient member may be first and second portions of a common element. Alternatively, first and second or multiple resilient members may be utilized. The resilient member may be formed of any material that provides a restorative force upon compression. In one arrangement, the resilient member is formed of a spring such as a leaf spring, coil spring, etc. In another arrangement, the resilient member is formed of one or more resilient elements (e.g., rubberized blocks).

In a further arrangement, an anchor point or engagement structure is connected to the upper leg. In one specific arrangement, the engagement structure extends transversely away from the upper leg. The engagement structure provides a location to attach components to the clamp. Alternatively, a track engaging member may be attached to the engagement structure. Such a track engaging member may be configured for selective movement between first and second positions relative to engagement structure and hence the track rail. In one specific arrangement, the track engaging member is a threaded element that may be threaded relative to an aperture within the engagement structure. In this regard, an end of the track engaging element may be utilized to compress a component (e.g., track heater, signal line etc.) against the surface of the track rail.

According to another aspect, a method is provided for attaching a clamp to a track rail. The method includes inserting a slot of a rail clamp having a first leg and a second leg defining a u-shaped portion of the clamp over a first flange of the track rail. The first leg extends at least partially over a top surface of the first flange and the second leg extends under a foot portion of the track rail. During insertion, a compressive force is applied to the closed end of the U-shaped slot, which compresses a resilient member disposed in the slot. Once the resilient member is compressed, a tab disposed on a free end of the second leg is positioned over an outside edge of a second flange of the track rail. At this time, the compressive force applied to the clamp may be released to allow the resilient member to expand and thereby provide an expansive force between the closed end of the clamp and the tab. This expansive force maintains the clamp in contact with the rail.

In a further arrangement, a track engaging element may be moved into contact with the track rail to lock the clamp into position on the rail.

BRIEF DESCRIPTION OF THE DRAWINGS

For a more complete understanding of the present invention and further advantages thereof, reference is now made to the following Detailed Description taken in conjunction with the drawings in which.

DETAILED DESCRIPTION

The presented inventions are directed to various anchoring/clamping mechanisms (e.g., clamps) that permit non-invasively holding a component relative to the surface of a railroad track rail. The anchoring mechanisms are operable to hold a variety of different components relative to the surface of such track rails. However, in the following description the clamping mechanism is set forth primarily in the context of non-invasively holding a heater element relative to the surface of a track rail. It will be appreciated, however, that certain aspects of the presented inventions are not limited to such applications.

Figure 1:
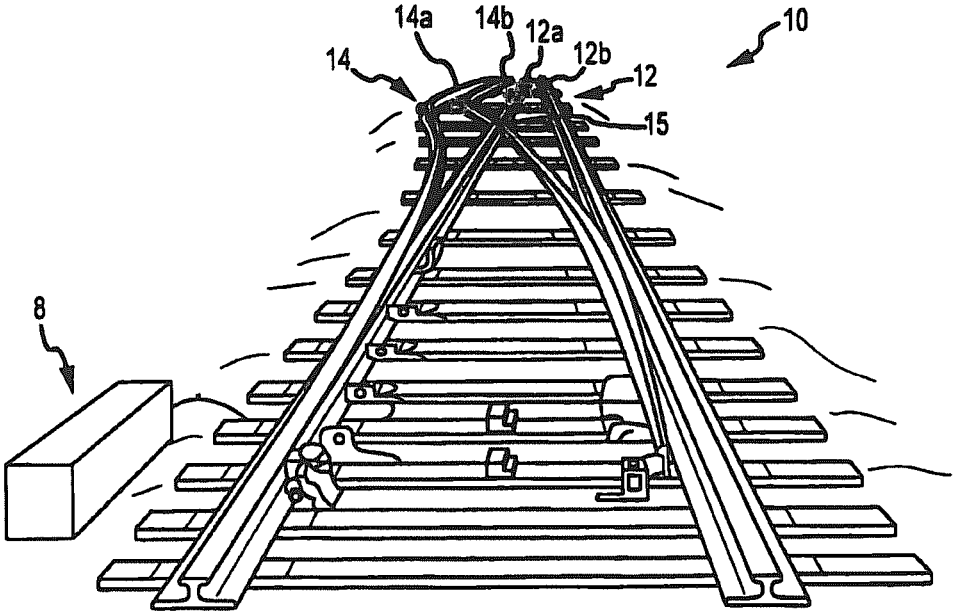
FIG. 1 shows a section of railroad track rails.

Referring to FIG. 1, a section of railroad track is generally identified by the reference numeral 10. As shown, the section of railroad track 10 includes a switching mechanism to switch trains between first and second tracks 12, 14. Each set of tracks 12, 14 includes two of track rails. As shown, the first track 12 includes a switching rail 12*a* and a stationary or stock rail 12*b* (also known as a running rail). Likewise, the second track 14 includes a stock rail 14*a* and a switching rail 14*b*. For purposes of controlling traffic, each track rail 12, 14 is electrically interconnected to a signal providing and monitoring system 8 that is located in proximity to the rail connection location The signal providing and monitoring system 8 is operative to operate heating elements attached to the track rails and redirect trains from the first track 12 to the second track 14 by mechanically moving the switching rails 12*a* and 14*b* relative to the stock rails 12*b* and 14*a*, respectively. Generally, a switch mechanism is mechanically interconnected to the switching rails 12*a* and 14*b* in order to move them in unison relative to the stock rails 12*b* and 14*a* at the connection point. In the case of switching rail 14*b*, mechanical movement may occur on both ends. That is, a first end of the switching rail 14*b* may be moved relative to the stock rail 12*b* and a second end of the switching rail 14*b* may be moved relative to a distal portion of switching rail 12*a*, where these rails cross. This point is sometimes referred to as a railroad "frog" 15. The frog 15 may in some instances be a passive spring actuated system that utilizes the pressure from the wheels of a passing railroad vehicle to permit railroad vehicle wheels to access the correct track. Alternatively, the frog 15 may be mechanically actuated/moved to permit railroad vehicle wheels to access the correct track.

It will be appreciated that proper operation requires good contact between the fixed rail and switching rail in the reverse position and between the fixed rail and switching rail in the normal position. To ensure good contact, such switching mechanism often incorporate track rail heaters that reduce or substantially eliminating build up of ice or snow at the switch interface. Other track locations also make use of heater to prevent/reduce snow and ice accumulation.

Figure 2B:
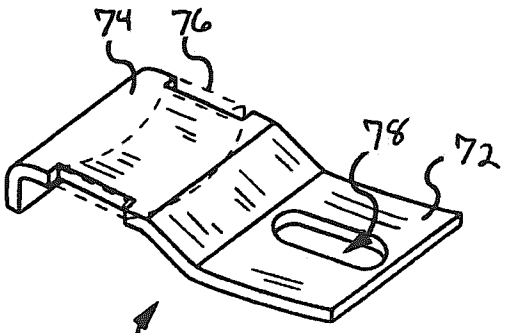
FIG.2B (PRIOR ART)
FIG. 2B shows a prior art clamp.
Figure 2A:
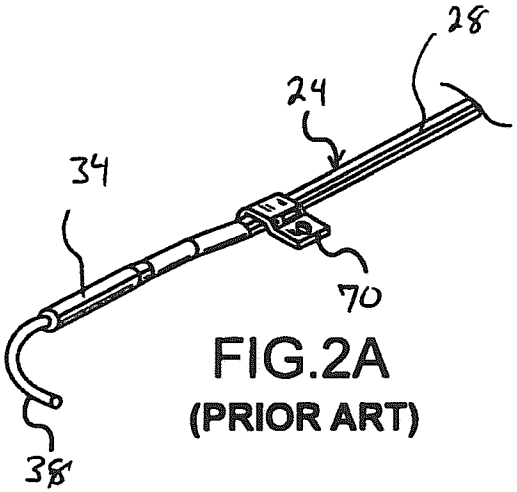
FIG.2A (PRIOR ART)
FIG. 2A shows an exemplary track heater.
Figure 3:
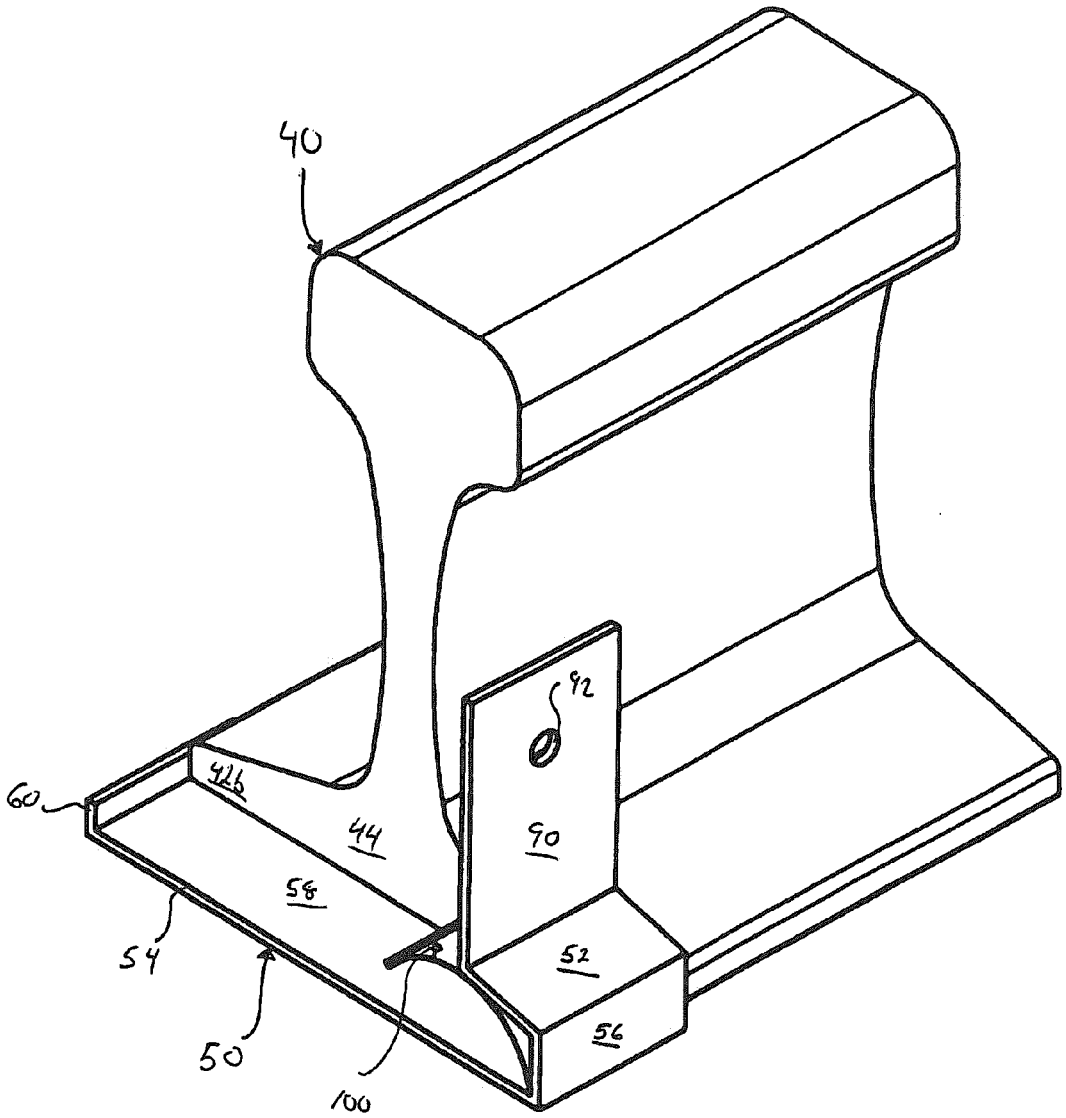
FIG. 3 shows a perspective view of a biasing clamp applied to a track rail.
Figure 4:
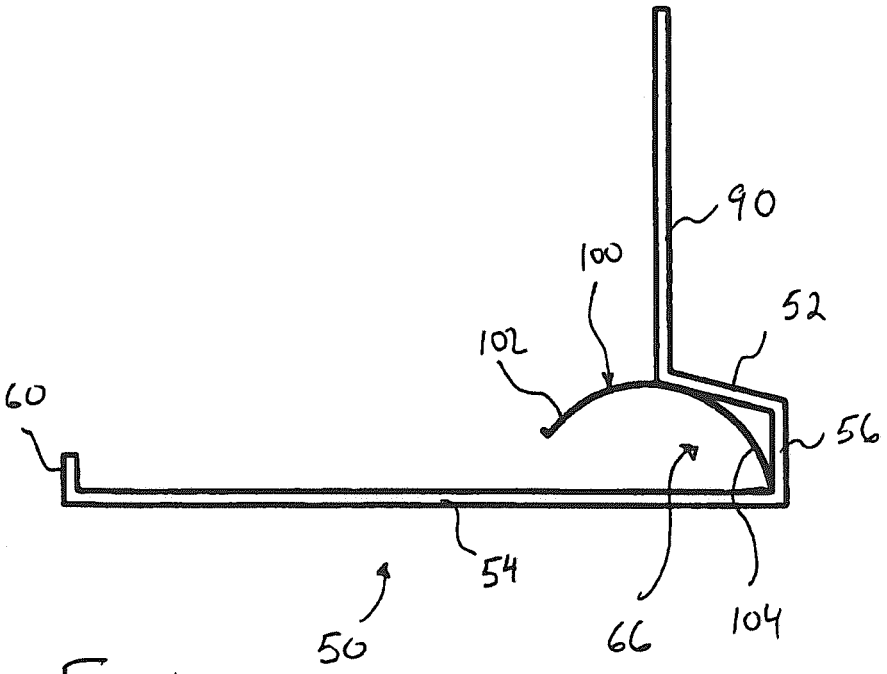
FIG. 4 shows a side view of the biasing clamp of FIG. 3.
Figure 5:
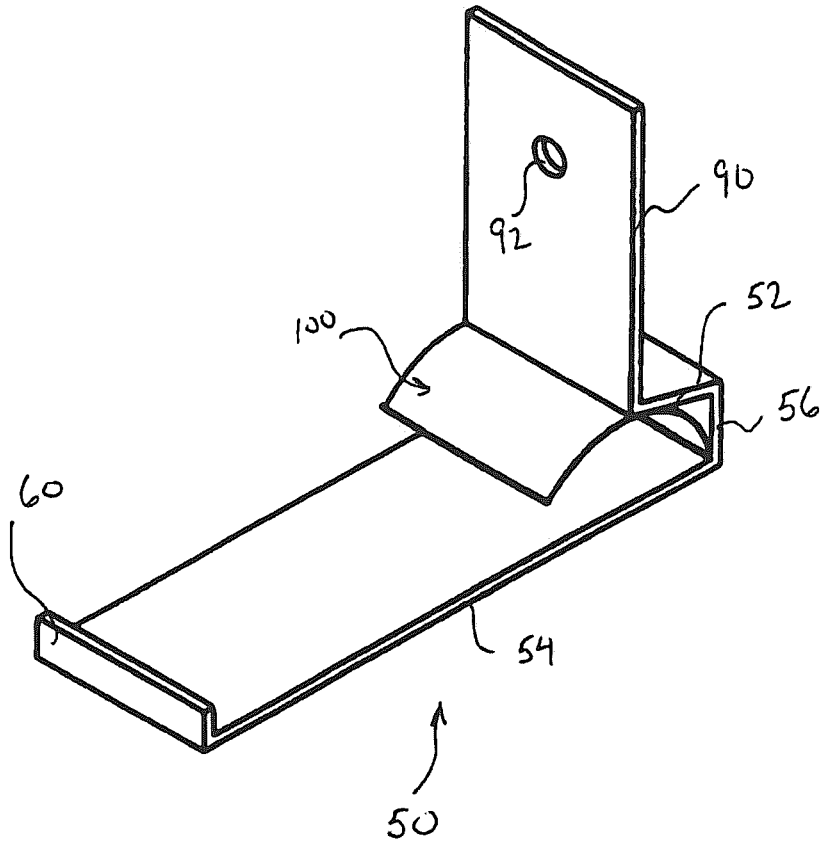
FIG. 5 shows perspective view of the biasing clamp of FIG. 3 removed from the track rail.

Referring to FIG. 2*a*, a track heater 24 is shown. As shown, the heater 24 includes an elongate housing 28 having a generally flat or blade-shaped jacket and a terminal sleeve 34 one end. Such track rail heaters may be of considerable length (e.g., exceed 36 feet in length) depending on their specific application. One such track heater is set forth in U.S. Pat. No. 5,824,997, the entire contents of which is incorporated herein by reference. Generally, an electrical line 38 connects the heater 24 to an external power source (not shown) such as a utilities outlet or, in remote locations, a generator or other independent source. The electrical line 38 is connected to terminals of the internal heater element(s) sealed within the jacket or housing 38. As shown, one or more prior art mounting brackets 70 may be disposed along the length of the track heater 24 to affix the track heater to the rail. Each mounting bracket 70 includes a first portion 72 for removably attaching (e.g., bolting via aperture 78) the mounting bracket 70 to a track rail, and a second portion or receiving bracket 74 for removably engaging the track heater 24. See FIG. 2B. The receiving bracket portion 74 may be in the form of a generally curved member that may define a concave space facing towards the track rail and sized to receive the track heater 24. In one arrangement, a spring clip 76 is positioned within the concave space for urging the track heater against the rail when the bracket is secured to the rail. Such a mounting bracket is disclosed in U.S. Pat. No. 6,104,010 the contents of which are incorporated herein by reference. As shown, the bracket is designed to be bolted to the track rail requiring a laborious process to secure a heater element to the track rail.

FIGS. 3-6 show one embodiment of a biasing clamp 50 that may be utilized for holding a component to a surface of a railroad track rail 40. This biasing clamp is non-invasive in that it does not penetrate the surface of the rack rail. Rather, the biasing clamp 50 applies a compressive force between opposing members to secure the biasing clamp 50 to the track rail 40. In addition, the biasing clamp 50 includes a track engaging member 80 (see FIG. 6) for use in selectively compressing a component, such as a heater or signal conductor, against the surface of the track rail 40. In the present embodiment, the biasing clamp 50 includes opposing legs; a top leg 52 and a bottom leg 54 for engaging top and bottom surfaces of a first flange 42*a* of the foot 44 of the track rail 40. As shown, first ends of the opposing legs 52, 54 are attached by a closed end 56 of the clamp. Collectively the upper leg, lower leg and closed end define a receiving slot 66 (see FIG. 4) that is sized to receive the first flange portion 42*a* of the foot 44 of the track rail 40. See FIGS. 3 and 6. In this regard, the upper leg, 52, lower leg 54 and closed end 56 of the biasing clamp 50 generally define a U-shaped body of the clamp.

The lower leg 54 is adapted for positioning below a bottom surface of the foot of the track rail 40. Specifically, when the clamp 50 is attached to a track rail 40, an upper surface 58 of the lower leg 54 is juxtaposed relative to the bottom surface of the foot of the track rail. The lower leg 54 has a length that is slightly longer than the width of the foot of the track rail as measured between the opposing outside surfaces of the first and second flanges, 42*a*, 42*b*. Attached to the free end of the lower leg is a tab 60. This tab 60 extends transverse to the upper surface 58 of the lower leg 54 and is adapted to engage an outside edge surface of a second flange 42*b* of the track rail when the first flange 42*a* is disposed within the receiving slot 66 proximate to the closed end of the U-shaped body. To reduce the likelihood of the tab 60 being depressed downward and potentially removing the clamp form the track rail, the length of the tab may be slightly less than the thickness of the outside edge of the second flange 42*b*. Further, the tab may be tapered to reduce incidental contact. However, the configuration of the tab does not require such length and tapering. For instance, in other embodiments, the tab may extend above and slightly inward of the top edge of the second flange 42*b*.

Attached to a second end of the upper leg 52 is an engagement or attachment structure 90 that provides a mount for use in holding a component relative to a surface of the track rail 40. As shown, the attachment structure 90 extends transverse to the upper leg 52 in a generally upright orientation. However, other orientations are possible. In the present embodiment, a threaded element 82 of the track engaging member 80 extends through an aperture 92 in the upright attachment structure 90. See FIGS. 3 and 6. The track engaging member 80 may be in the form of a bolt, screw and the like. In this embodiment, the threaded fastener extends through an aperture 92 in the attachment structure. In one embodiment, the aperture is threaded. In another embodiment, one or more set nuts 86 may be connected to the attachment structure. In any embodiment, the threaded element 82 can be advanced or retracted relative to the attachment structure.

Figure 6:
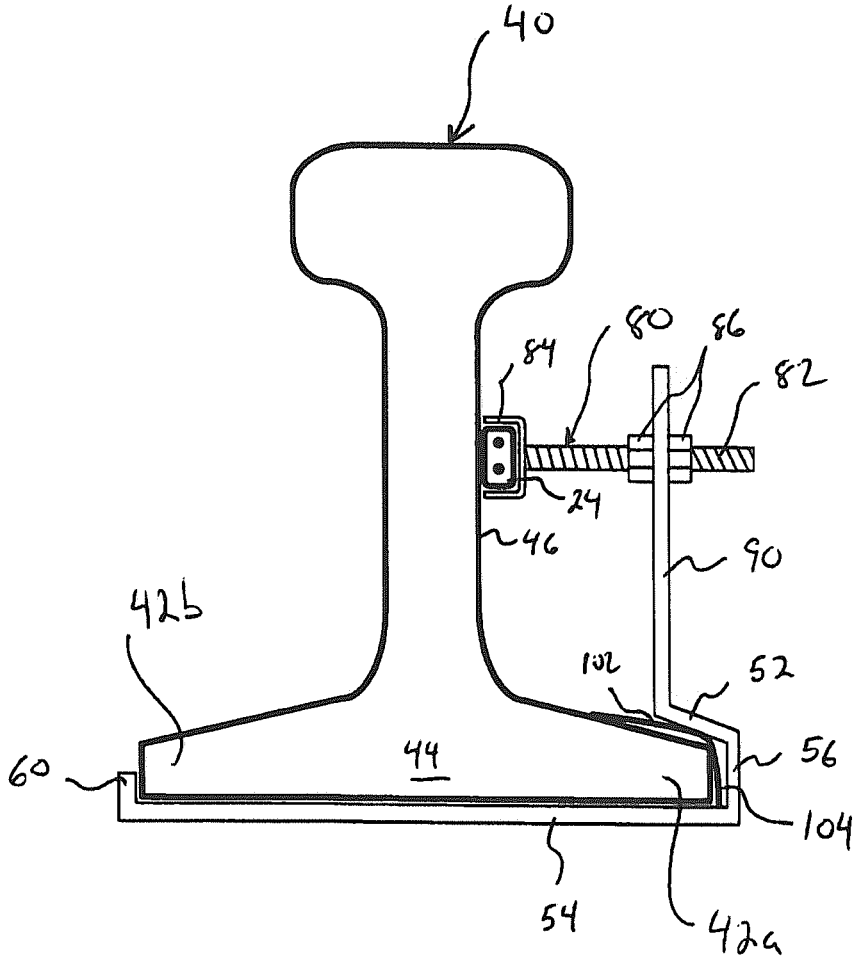
FIG. 6 shows a side view of the biasing clamp applied to a track rail.

As shown in FIG. 6, the track engaging member 80 allows for selectively positioning a holding bracket 84 relative to a web surface of the track rail using the treaded element 82. This allows for securely pressing a component, such as a heater 24 or signal line, relative to a surface of the track rail 40. Though the holding bracket 84 is shown as being substantially U-shaped, it will be appreciated that the holding bracket 84 may be otherwise shaped to, for example, accommodate differently shaped components. Additionally, the inside surface of the bracket 84 may include a spring (e.g., a leaf spring; not shown) for applying additional compressive force between the bracket 84 and a component held there beneath. Further, the holding bracket may be removable from the threaded element 82.

The position of the holding bracket 84 is adjustable utilizing the threaded element 82 (e.g., bolt). That is the threaded adjuster 82 in the embodiment shown may be selectively threaded relative to the aperture 92 in the attachment structure 90. Accordingly, by selectively threading the threaded element 82, the position of the holding bracket 84 may be moved in/out relative to the surface of the track rail 40. Furthermore, the position of the threaded adjustor may be affixed by or more set nuts 86 and/or by one or more set screws (not shown).

A resilient member 100 is disposed in the slot 66 defined between the upper leg 52 and lower leg 54. See FIGS. 4 and 6. In the illustrated embodiment, the resilient member is formed as a leaf spring. However, it will be appreciated that the configuration of the resilient member 100 may be varied. For instance, and without limitation, coiled springs and/or resilient elements (e.g., rubber or polymer blocks) may form the resilient member. What is important is that, when the resilient member 100 is compressed, it exerts a restorative/expansive force that acts to return the resilient member 100 back to or nearly to its original shape.

In the illustrated embodiment, the resilient member 100 is attached to the upper leg 52 at a location spaced from the closed end 56 of the U-shaped body. Further, the resilient member 100 includes a first portion 102 that is disposed between the bottom surface of the upper leg 52 and a top surface of a flange 42*a* of a track rail 40 when the biasing clamp 50 is applied to the track rail 40. See FIGS. 4 and 6. Further, a second portion 104 of the resilient member 100 is at least partially compressed between the closed end 58 of the U-shaped body and an outside edge surface of the first flange 42*a* of the track rail when the biasing clamp 50 is applied to the track rail 40. Such compression is more fully discussed below. In the present embodiment, where the resilient member 100 is formed of a leaf spring, the first portion 102 includes a first end section of the leaf spring and the second portion 104 includes a second end section of the leaf spring. In this embodiment, a mid-section of the leaf spring may be attached (e.g., riveted, bolted, welded etc.) to the top leg of the biasing clamp 50. In other embodiments, first and second resilient members may be utilized.

In application of the biasing clamp 50 to the track rail 40, a flange 42*a* is disposed within the slot 66. The flange 42*a* initially contacts the second portion 104 of the resilient member 100. After initial contact, this second portion 104 of the resilient member 100 is compressed allowing the tab 60 on the second end of the lower leg 54 to be positioned over the outside edge of the second flange 42*b*. Once so positioned, the second portion 104 of the resilient member 100 provides an expansive force between the closed end 56 of the U-shaped body and the tab 60 of the lower leg 54. This expansive force maintains the clamp 50 on the track rail 40. In conjunction with the compression of the second portion 104 of the resilient member 100, the first portion 102 of the resilient member 100 is compressed between the bottom surface of the top leg 52 and a top surface of the first flange 42*a*. The compression of the first portion 102 of the resilient member 100 provides an expansive force between the top leg 52 and the first flange 42*a* and thereby maintains the top surface 58 of the bottom leg 54 in contact with the bottom surface of the foot 44 of the track rail 40. Collectively, the first and second portions 102, 104 of the resilient member 100 secure the biasing clamp 50 in secure contact with the track rail 40. Further, the spring constant of the resilient member may be selected such that compression of the first and second portions may be affected without the use of tools (e.g., hammers, etc.). That is, the biasing clamp 50 may be applied to the track rail 40 by hand.

Once the biasing clamp 50 is secured to the track rail 40, the track threaded element 82 of the track engaging member 80 may be advanced toward the web surface 46 of the track rail 40 and thereby secure a component (e.g., heater) between the bracket 84 and the web surface 46. Further, the advancement of the treaded element 82 against the web 44 of the track rail 40 provides a torque to the biasing clamp 50. This torque, in conjunction compression of the resilient member 100 works to force the second end of the lower leg 54 against the bottom surface of the foot 44 of the track rail 40 maintaining the tab 60 over the outside edge of the second flange 42*b*. Once this torque is applied to the biasing clamp 50, the clamp can no longer be removed from the track rail until the threaded element 82 is retracted from the web surface 46 of the track rail 40. That is, while the design of the biasing clamp 50 allows for application to the rail by hand, the advancement of the threaded element 82 locks the biasing clamp 50 in position and prevents removal without significant force. However, it will be appreciated that the clamp may also be utilized without the threaded element in various applications.

The physical configuration of any or all of the elements of the attachment structure may be altered. For instance, the height and/or geometry of the upstanding attachment structure may be increased or altered to allow for holding a component against another surface or the track rail. Likewise, the body of the clamp may be formed of any appropriate material including, without limitation, steels, aluminums, polymers and composite materials. In any arrangement, it is preferable that the body of the clamp has a structural rigidity that is greater than the spring constant of the resilient member. That is, the resilient member is designed to deflect/deform prior to deflection/deformation of the body of the clamp.

The foregoing description has been presented for purposes of illustration and description. Furthermore, the description is not intended to limit the invention to the form disclosed herein. Consequently, variations and modifications commensurate with the above teachings, and skill and knowledge of the relevant art, are within the scope of the various embodiments. The embodiments described hereinabove are further intended to explain best modes known of practicing the invention and to enable others skilled in the art to utilize the invention in such, or other embodiments and with various modifications required by the particular application(s) or use(s) of the various embodiments. It is intended that the appended claims be construed to include alternative embodiments to the extent permitted by the prior art.

The invention claimed is:

1. An anchor for securing a component relative to a surface of a track rail, comprising:

a U-shaped body having:

an upper leg adapted for disposition above a first flange of a foot of a track rail;

a lower leg for disposition beneath the first flange of the foot of the track rail, the lower leg having a free end with a tab attached thereto extending in a direction transverse to said top surface of said lower leg; and a closed end between said upper leg and said lower leg, wherein a bottom surface of said upper leg and a top surface of said bottom leg are disposed in a spaced and opposing relationship sized to receive the first flange of a track rail there between;

a resilient member positioned between said upper leg and said lower leg, wherein:

a first portion of said resilient member is compressed between the upper leg of said U-shaped body and the first flange of the foot of the track rail when the first flange of the foot of the track rail is disposed in said U-shaped body between said upper leg and said lower leg: and a second portion of said resilient member is positioned relative to said U-shaped body such that it is compressed between said closed end of said U-shaped body and an outside edge of the first flange of the foot of the track rail when the first flange of the foot of the track rail is disposed in said U-shaped body between said upper leg and said lower leg;

wherein said tab is adapted to engage the outside edge of the second flange of the track trail when the track rail is disposed in said U-shaped body between said upper leg and said lower leg and the second portion of the resilient member is compressed.

2. The anchor of claim 1, wherein said lower leg has a length greater than the width of the track rail measured from opposing outside edges of the first flange and a second flange of the track rail.

3. The anchor of claim 2, wherein said resilient member is fixedly attached to said upper leg.

4. The anchor of claim 1, wherein said second portion of said resilient means, when compressed, provides an expansive force between said closed end of said U-shaped member and said tab attached to said free end of said lower leg.

5. The anchor of claim 1, wherein said tab has a length that is less than or equal to a thickness of the outside edge of the second flange of the foot of the track rail.

6. The anchor of claim 1, wherein said resilient member comprises:

a leaf spring.

7. The anchor of claim 1, wherein an expansive force of said first portion of the resilient member, when compressed, maintains a portion of said top surface of said lower leg in contact with a bottom surface of the foot of the track rail.

8. The anchor of claim 1, wherein said upper leg has a length between a first end proximal to said closed end of said U-shaped member and a second end that is less than one-half the width of the track rail measured from opposing outside edges of the first flange and a second flange of the track rail.

9. The anchor of claim 1, further comprising:

an engagement structure connected to said upper leg and extending in a direction transverse to a length of said upper leg.

10. The anchor of claim 9, wherein said engagement structure further comprises:

a track engaging element attached to said engagement structure, wherein said track engagement element is configured for selective movement between a first position relative to said engagement structure and a second position relative to said engagement structure.

11. The anchor of claim 10, wherein said track engaging element comprises:

a threaded element disposed though an aperture in said engagement structure.

12. The anchor of claim 10, further comprising:

a bracket attached to said track engagement element, wherein said bracket is configured to compress a component to a surface of said track rail.

13. An anchor for securing a component relative to a surface of a track rail having a rail head and a foot with first and second flanges, comprising:

a base portion sized to underlay a foot of a track rail, said base portion having a substantially planar top surface for positioning relative to a bottom surface of the foot of the track rail;

a tab attached to a first end of said base portion and extending in a direction transverse to said top surface of said base portion, wherein said tab is adapted to engage an outside edge of a first flange of the track rail;

an upstanding portion attached to a second end of said base portion and extending in a direction transverse to said top surface of said base portion, wherein said upstanding portion is adapted for positioning proximate to an outside edge of an opposing second flange of the track rail;

a leg attached to said upstanding member at a location above said base portion and extending in a direction toward a centerline of the track rail and a resilient member associated with said upstanding portion, wherein:

a first portion of said resilient member is compressed between said upstanding portion and the outside edge of the second flange of the track rail when said tab engages the outside edge of the first flange and said top surface of said base portion is juxtaposed relative to the bottom surface of the foot of the track rail;

a second portion associated with said leg, wherein said second portion of said resilient member is compressed between said leg and a top surface of the second flange when said tab engages the outside edge of the first flange and the said top surface of said base portion is juxtaposed relative to the bottom surface of the foot of the track rail.

14. The anchor of claim 13, wherein said first portion of said resilient means, when compressed, provides an expansive force between said upstanding member and said tab.

15. The anchor of claim 13, further comprising:

an engagement structure connected to said leg and extending in a direction transverse to said top surface of said base portion.

16. The anchor of claim 15, wherein said engagement structure further comprises:

a track engaging element attached to said engagement structure, wherein said track engagement element is configured for selective movement between a first position relative to said engagement structure and a second position relative to said engagement structure.

17. The anchor of claim 16, wherein said track engaging element comprises:

a threaded element disposed though an aperture in said track engaging element.

18. The anchor of claim 16, further comprising:

a bracket attached to said track engagement element, wherein said bracket is configured to compress a component to a surface of said track rail.

* * * * *